US006263623B1

(12) United States Patent
Weiss et al.

(10) Patent No.: US 6,263,623 B1
(45) Date of Patent: Jul. 24, 2001

(54) METHOD AND APPARATUS FOR USING A DETENT ARRANGEMENT ON A ROOF WINDOW FRAME AND SASH

(75) Inventors: David J. Weiss, Stillwater, MN (US); James C. Guhl, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 09/206,136

(22) Filed: Dec. 7, 1998

(51) Int. Cl.[7] ..... E04B 7/18

(52) U.S. Cl. ..... 52/200; 52/127.8; 52/745.16; 49/463

(58) Field of Search ..... 52/200, 127.7, 52/127.11, 213, 215, 745.15, 745.16; 49/463

(56) References Cited

U.S. PATENT DOCUMENTS

| | | | | |
|---|---|---|---|---|
| 1,570,351 | * | 1/1926 | Hultin . | |
| 2,328,757 | * | 9/1943 | Tinnerman . | |
| 2,722,170 | * | 11/1955 | Broberg . | |
| 2,902,727 | * | 9/1959 | Samolis . | |
| 2,939,185 | * | 9/1960 | Ader et al. . | |
| 3,491,486 | * | 1/1970 | Caruth . | |
| 3,979,796 | * | 9/1976 | MacDonald . | |
| 4,296,576 | | 10/1981 | Rice, Jr. et al. . | |
| 4,488,391 | * | 12/1984 | Pavica | 52/213 X |
| 4,788,804 | | 12/1988 | Haas . | |
| 5,044,133 | | 9/1991 | Sampson et al. . | |
| 5,207,036 | * | 5/1993 | Sampson et al. | 52/72 |
| 5,216,855 | * | 6/1993 | Richter et al. | 52/200 |
| 5,271,124 | | 12/1993 | Sandell . | |
| 5,355,644 | | 10/1994 | Guhl et al. . | |
| 5,357,720 | | 10/1994 | O'Keeffe et al. . | |
| 5,509,361 | | 4/1996 | Chen . | |
| 5,544,455 | * | 8/1996 | DeBlock | 52/200 |
| 5,546,712 | | 8/1996 | Bixby . | |
| 5,682,713 | | 11/1997 | Weiss . | |

FOREIGN PATENT DOCUMENTS

91914 * 11/1958 (NO) .

OTHER PUBLICATIONS

Andersen® Skylight 1991 thru Present, manufacturer's literature, pp. 174–177 (Aug. 15, 1991).
The Andersen® Skylight Basic Installation Guide, pp. 176–181 (undated).
Andersen Corporation Bracket Installation Drawing, 1 page (Sep. 20, 1994).

* cited by examiner

*Primary Examiner*—Robert Canfield
(74) *Attorney, Agent, or Firm*—Merchant & Gould P.C.

(57) ABSTRACT

A roof window assembly adapted to be mounted to cover an opening in a roof structure of a building and method of installing and removing the roof window. The assembly includes a glass unit and a sash member operatively connected to the glass unit. A frame member is adapted and configured to be secured to the roof proximate its opening. A detent arrangement is on the frame and the sash, wherein after the frame is secured to the roof, the sash is placed on the frame and the detent arrangement mechanically secures the sash to the frame.

15 Claims, 5 Drawing Sheets

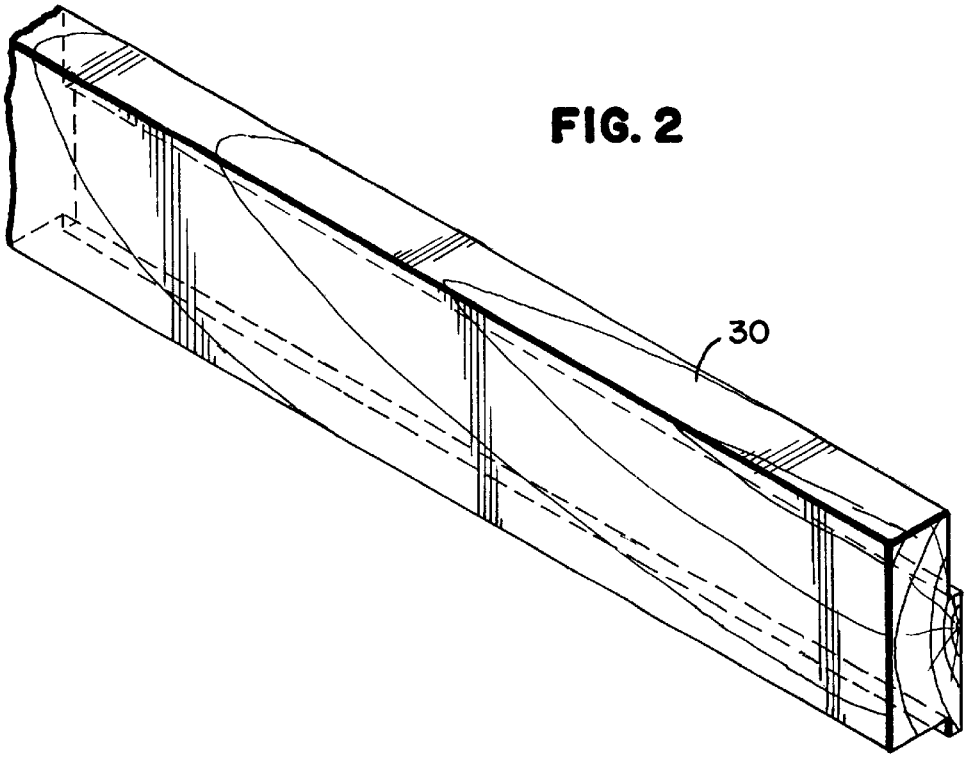
FIG. 2
FIG.1
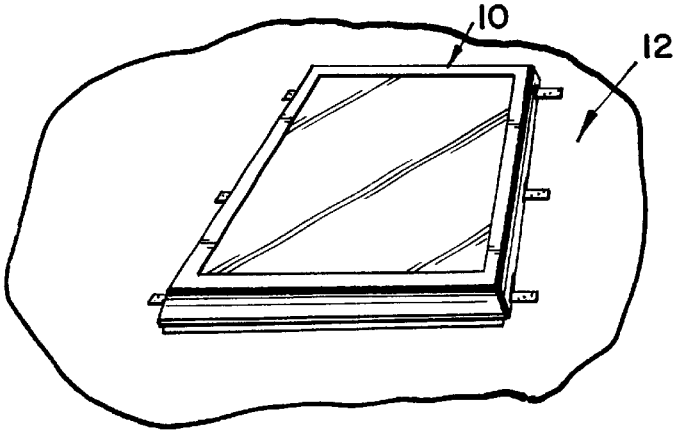

METHOD AND APPARATUS FOR USING A DETENT ARRANGEMENT ON A ROOF WINDOW FRAME AND SASH

BACKGROUND OF THE INVENTION

1. Field of the Invention

The invention relates generally to securing a roof window sash to the roof window frame and more particularly to a detent arrangement for allowing a snap-on fit between a frame and a sash to simplify the installation of roof window and flashing components on a roof.

2. Description of the Prior Art

Roof windows are windows that are placed on the roof of a structure. Skylights are also windows placed on the roof of a structure. The typical definition of a roof window is different from a skylight in that roof windows can be opened and closed. However, for purposes of this application, including the claims of this application, the term "roof window" will be used to mean both roof windows and skylights and any other type of window that is placed on the roof of a structure. The installation of a roof window to a roof of a dwelling requires the securing of a roof window's frame to the dwelling's roof. The installation then typically requires the installation of metal flashing and/or flexible roofing membrane material adjacent to the frame but under the counterflashing on the sash. Roof windows can be placed overhead or at eye level and installed to permit a light shaft that is straight, oblique, or flared.

Presently, roof window's frames are attached to the dwelling's roof by brackets that are well known in the art. The brackets range from an angle iron to complicated configurations that are relatively expensive to manufacture. One such bracket is shown in U.S. Pat. No. 5,682,713, entitled ROTATABLE BRACKET SECURING A WINDOW FRAME TO A ROOF, which is hereby incorporated by reference.

In the building trades, roofers typically will not go inside a house. Therefore, it is advantageous to have the roof window attached from the outside. With the roof windows of the prior art, the entire sash and frame are installed at the same time since the sash is attached to the frame at the factory. This not only makes installation more difficult, it also increases the complexity of servicing if there is broken glass or a seal failure. The metal flashing and roofing membrane must be adjacent to the frame and between the frame and the sash to ensure a proper weatherproof installation. If the sash, including the counterflashing, is secured to the frame, the entire unit must be installed before the flashing and the roof membrane can be installed. The installer is then faced with the very difficult task of forcing the roofing membrane and flashing between the counterflashing of the sash and the frame. Even with the rotatable bracket, when the window frame is secured to the roof, the sash is also secured. That is, the sash is always affixed to the frame before installation.

Many installers prefer to do a "bare frame" installation (wherein the frame is installed apart from the sash) for improved waterproofing. For "bare frame" installation the installer must remove the sash from the frame and this requires an extended period of time and great care with the multiple components that are required to install these assemblies. These assemblies require the removal of numerous screws and sheet metal parts for installation. Not only does this take more time and effort, but it also risks the loss or damage to the screws and other parts. Also, the exposed screws have a potential to create weatherproofing problems.

The alternative to the "bare frame" installation is the sash and frame being installed as one unit. But as discussed above, the installation of a single fixed unit has problems with positioning of the roofing membrane and flashing between the frame and the sash.

The present invention addresses the problems associated with the prior art and provides for easy installation and weatherproofing of the frame to the roof of the dwelling and easy and quick installation of the sash and glass unit on the prepared frame.

SUMMARY OF THE INVENTION

In one embodiment, the invention is a roof window assembly adapted to be mounted to cover an opening in a roof structure of a building. The assembly includes a glass unit and a sash member operatively connected to the glass unit. A frame member is adapted and configured to be secured to the roof proximate its opening. A detent arrangement is on the frame member and the sash member, wherein after the frame member is secured to the roof, the sash member is placed on the frame member and the detent arrangement mechanically secures the sash member to the frame member.

In another embodiment, the invention is a roof window assembly adapted to be mounted to cover an opening in a structure of a building. The assembly includes a glass unit and a sash member operatively connected to the glass unit. The frame member is adapted and configured to be secured to the structure proximate its opening. A spring clip is operatively connected to the frame member. The spring clip has an extended, engaged position and a depressed, disengaged position. The sash member has a profile adapted and configured to be placed on the frame member. The sash has a ridge member. The ridge member is positioned to depress the spring clip as a sash member is placed on the frame member and to release the spring to its extended position when the sash member is in position. The sash member and spring clip form a snap-fit arrangement for the roof window assembly.

In another embodiment, the invention is a method of installing a roof window assembly to cover an opening in a structure of the building. The roof window assembly comprises a glass unit, a sash member, the glass unit being operatively connected to the sash member and a frame member which is adapted and configured to be secured to the structure proximate its opening. The roof window further includes a detent arrangement on the frame member and sash member. The method includes securing the frame around the opening in the structure. Then, the sash member is placed over the frame member while the detent arrangement is in a disengaged position and finally positioning the sash member in an assembled position as the detent arrangement is in an engaged position.

In another embodiment the invention is a method of installing and later removing a roof window assembly to cover an opening in a structure of a building. The roof window assembly includes a glass unit and a sash member. The glass unit is operatively connected to the sash member and a frame member is adapted and configured to be secured to the structure proximate its opening. The roof window assembly includes a detent arrangement on the frame member and the sash member. The sash member has a profile and the profile has an opening adjacent the detent assembly on the frame member. The method includes securing the frame member around the opening in the structure. Placing the sash member over the frame member while the detent arrangement is in the disengaged position. The sash member is then positioned to an assembled position as the detent arrangement is in an engaged position. Then, to remove the sash member, a tool is placed into the hole or a screw is driven in to move the detent arrangement from the engaged position to the disengaged position and remove the sash member from the frame member.

BRIEF DESCRIPTION OF THE DRAWINGS

FIG. 1 is a perspective view of a roof window incorporating the present invention;

FIG. 2 is a perspective view of the frame portion of the roof window shown in FIG. 1;

DETAILED DESCRIPTION OF THE PREFERRED EMBODIMENT

The preferred application of this invention is in the installation of a roof window 10 upon the roof deck 12 of a dwelling, as shown in FIG. 1. For this application a "roof window" will also include skylights. Although the example of installing a roof window 10 will be utilized herein, those skilled in the art will appreciate that such application is only one of many circumstances in which principles of the present application may be utilized. Accordingly, the roof window example presented herein should not be construed in a limiting manner. Also, those skilled in the art will appreciate that the present invention is illustrated as an installation of a single roof window 10, it should be understood that any number of roof windows in tandem can be installed utilizing the present invention, as well as other styles of roof windows.

FIG. 2 refers to a typical frame member 30 used in the roof window assembly. The frame member attaches to the roof deck 12 of a structure.

Figure 3:
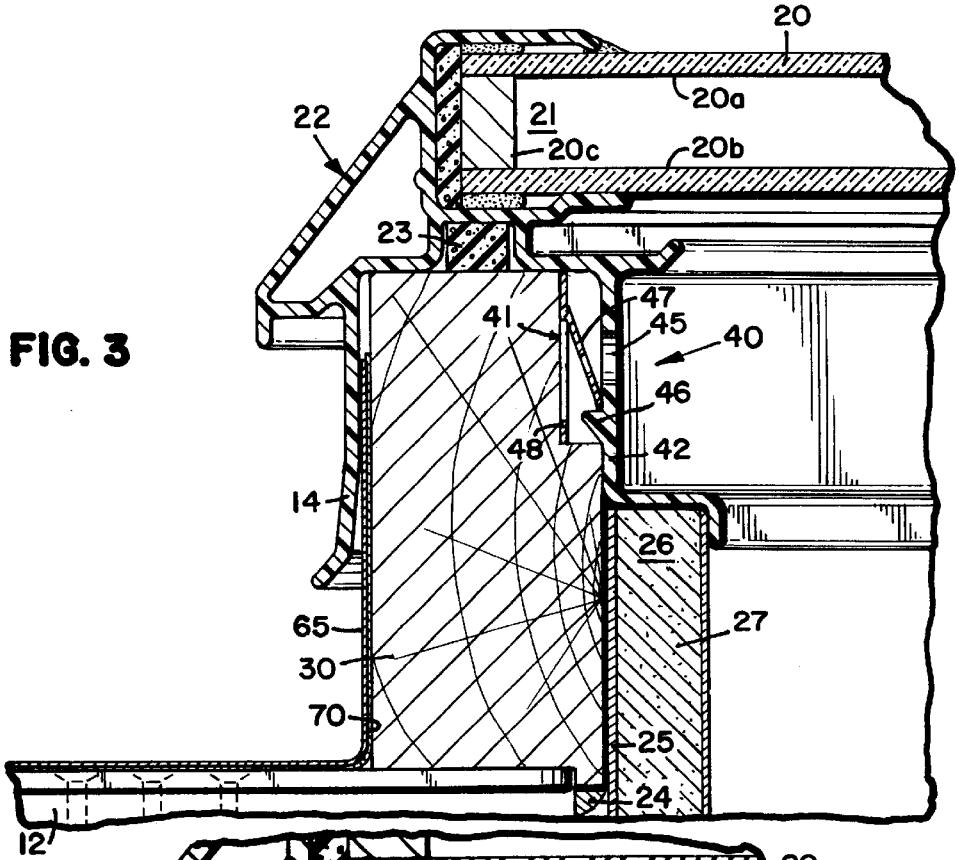
FIG. 3 is a sectional view of the roof window shown in FIG. 1 with the detent arrangement in the engaged position.

Referring to FIG. 3, there is shown a typical mounting of a roof window 10. A glass unit 20, including two panes of glass 20*a* and 20*b* and a spacer 20*c*, has an edge disposed in a sash channel or rabbet 21 of a sash 22. The sash member 22 is secured to roof window frame member 30 by a detent arrangement 40 which will be described in more detail hereafter. The sash member 22 is a framework that encloses the circumference of the glass unit 20. A foam seal 23 between and in contact with the sash member 22 and frame member 30 prevents air and moisture from infiltrating between the frame member 30 and the sash member 22. The glass unit 20, sash member 22, frame member 30, and foam seal 23 may be constructed of various materials in multiple configurations.

A sealant 24 is provided along the joints in between the exterior extension of the frame member 30 and the roof deck 12. The sealant is preferably silicone but may be any suitable material. The sealant 24 prevents air and moisture from infiltrating between the frame member 30 and the roof deck 12. A vapor barrier 25 is attached between the dry wall 27 and the frame member 30.

The dry wall channel 26 typically has ⅝ inch thick dry wall 27 disposed within the channel or other surfacing material. If required, furring strips may be provided on the interior side of the dry wall 27 and connected to suitable headers of the roof deck 12. The furring strips are shims to aid in the appearance and support of the dry wall 27.

A counterflashing 14 of the sash 22 is situated adjacent to a metal flashing 65 and a roof membrane 70 which partially covers the frame member 30. The purpose of the counterflashing 14 is to direct water away from the frame member 30 and onto the metal flashin 65.

The detent arrangement 40 mechanically secures the sash member 22 to the frame member 30. The detent arrangement 40 has a first part 41 and a second part 42. In the one embodiment the first part 41 is a spring clip operatively connected to the frame member 30. The second part 42 is a portion of the sash member 22.

Figure 4:
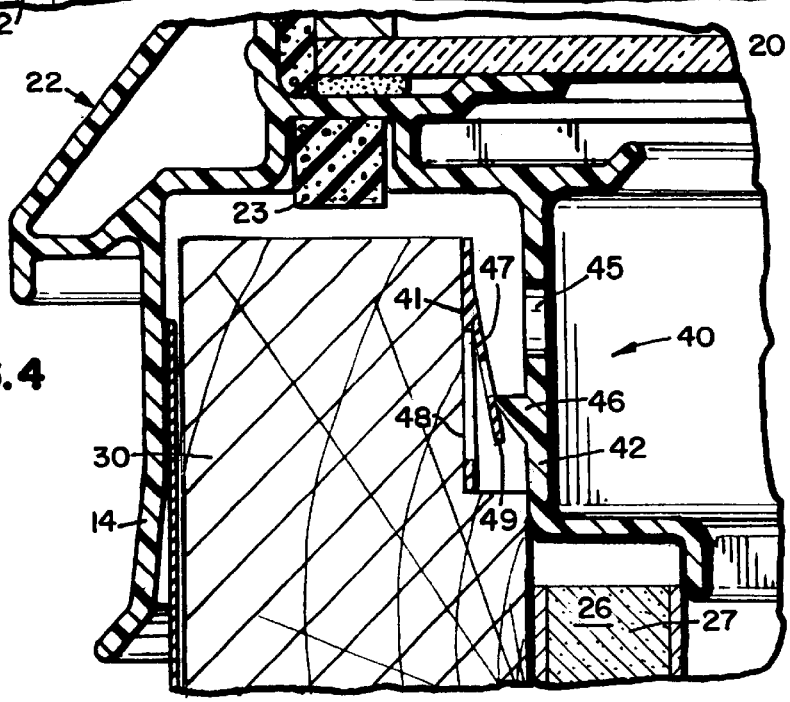
FIG. 4 is an enlarged sectional view of a portion of the view of FIG. 3 with the detent arrangement in the disengaged position just prior to being inserted onto the frame member.

The detent arrangement 40 has an engaged position shown in FIG. 3 and a disengaged position shown in FIG. 4. FIG. 3 shows the engaged position wherein the detent arrangement 40 mechanically secures the sash member 22 to the frame member 30. FIG. 4 shows the disengaged position wherein the detent arrangement 40 does not mechanically secure the sash member 22 to the frame member 30.

The detent arrangement 40 may also have an opening or hole 45 located on the profile of the sash member 30 adjacent to the first part 41 of the detent arrangement 40. The opening 45 provides access to move the first part 41 from the engaged position to the disengaged position. The opening 45 allows for easy removal of the sash member 22 from the frame member 30.

In one embodiment of the invention the fist part 41 of the detent arrangement 40 is a spring clip 41 mounted to the frame member 30. The spring clip 41 can be mounted to the frame member 30 by a variety of methods such as adhesives or fasteners such as screws. The spring clip 41 can be any suitable rigid material, such as steel. A plurality of spring clips 41 may be placed around the perimeter of the assembled frame member 30. The sash member 22 has a profile shaped and configured to be placed over and around the frame member 30 and operates as a catch. The profile has a ridge member 46 on the second part 42. As the sash member 22 is placed over the frame member 30, the ridge member 46 depresses the spring clip 41 as shown in FIG. 4 until the ridge member 46 passes the clip 41 which then allows the spring clip to move to the extended, engaged position as shown in FIG. 3. The sash member 22 and spring clip 41 form a snap fit arrangement for the roof window assembly. In the illustrated embodiment, the ridge member 46 is the catch. However, for purposes of this application the term "catch" means any mechanism or profile that prevents the sash member 22 from being removed from the frame member 30 once the spring clip 41 or other embodiment of the first part of the detent arrangement is in its engaged position.

Figure 5:
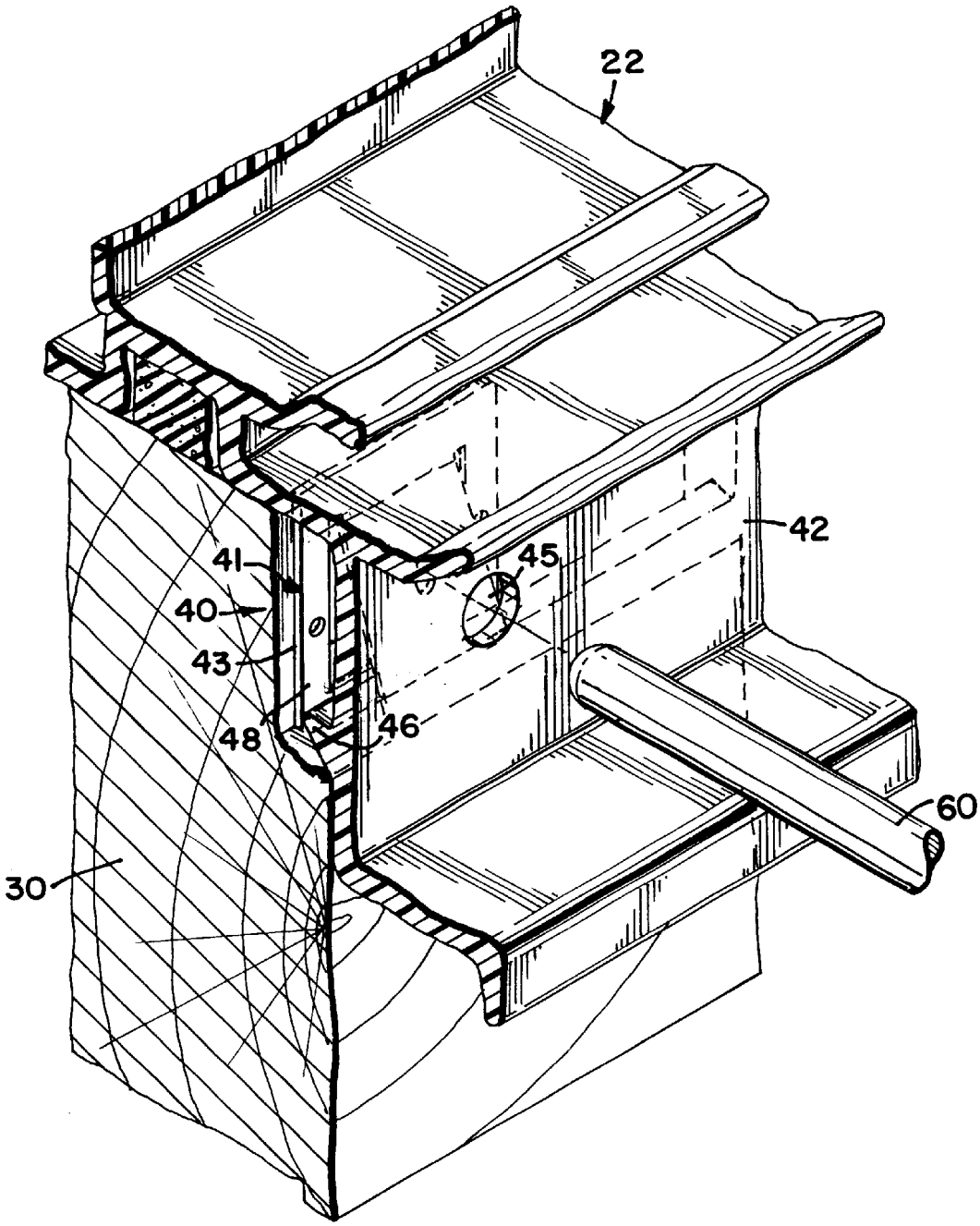
FIG. 5 is an enlarged perspective view showing the use of a tool to disengage the detent assembly.

Referring to FIG. 5, removal of the sash member from the frame member is accomplished by moving the clip 41 into the disengaged position. Movement of the clip 41 is accomplished easily by inserting a tool 60 or by driving a screw into the opening 45 located on the profile of the sash member 22 adjacent to the spring clip 41 of the detent arrangement 40. The opening 45 provides access to move the clip 41 from the engaged position to the disengaged position. FIG. 4 shows the clip 41 in the disengaged position which allows for easy removal of the sash member 22 from the frame member 30.

Figure 6:
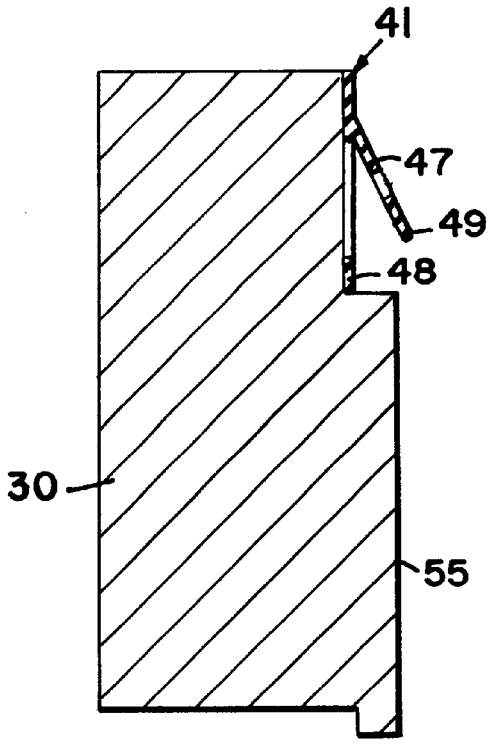
FIG. 6 is a sectional view of the spring clip mounted on the frame member with the sash member removed.

FIG. 6 shows the spring clip 41 attached to the frame member 30 with the sash member 22 removed. The spring clip 41 includes a flat part 48 and an extended part 47. The extended part 47 includes a tip 49 which is the farthest end from the flat part 48. When the spring clip of the preferred embodiment is in a noncompressed state (i.e., before the sash is placed in contact with the spring clip 41), the extended part 47 intersects the plane of the surface 55 of the frame member 30. The following dimensions of the spring clip 41 are given for example only and are not limiting to this invention. The distance from the tip 49 of the extended part 47 to the flat part 48 along the line normal to the flat part 48 is approximately 0.313 inches. The length of the flat part 48 is approximately 1.162 inches.

Figure 7:
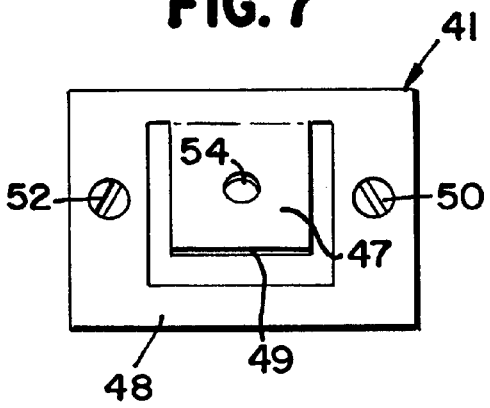
FIG. 7 is a frontal view of a spring clip.

FIG. 7 shows a front view of the spring clip 41. A first screw 50 and a second screw 52 for attaching the spring clip 41 to the frame 30 are also shown. The screws 50 and 52 are not shown in the other figures and it is noted that other means such as adhesives may also be used to attach the spring clip 41 to the frame 30. A screw may be driven rough the opening 45 and hole 54 into the frame 30 to the point where the head of the screw holds the extended portion 47 in an unengaged position whereby the sash may be removed. The use of such a screw would replace the use of tool 60. For purposes of this application, the term "tool" refers to any device utilized to hold the spring clip in a position in which the sash can be removed from the frame including, but not limited to, a screw or the tool 60.

Figure 8:
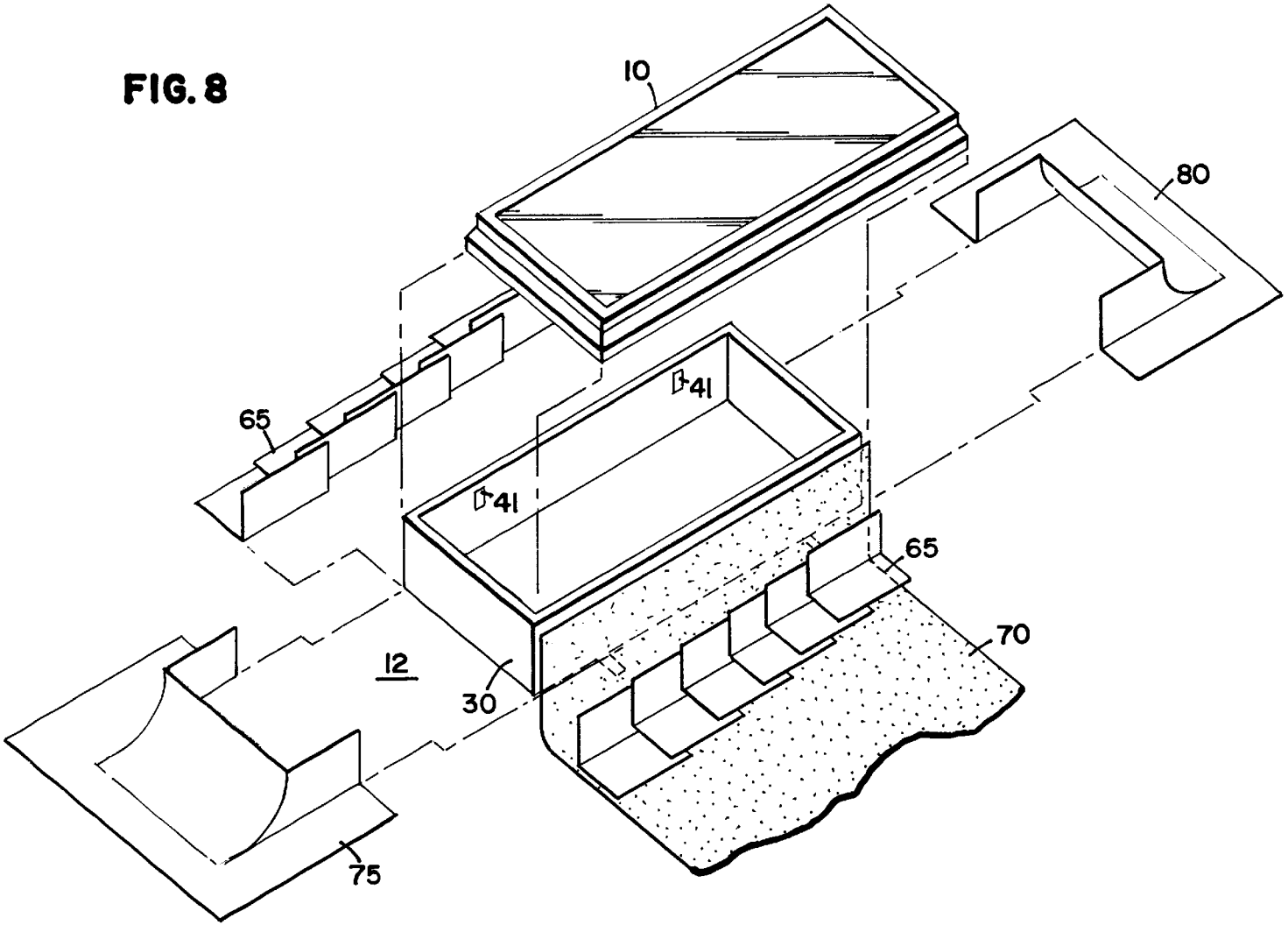
FIG. 8 is a perspective view of the entire roof window assembly, roofing membrane and metal flashing components.

FIG. 8 refers to a typical roof installation used in the roof window assembly of the invention. The frame 30 is placed over an opening in the roof and is fixed to the roof via brackets or other means. The roof membrane 70, which can be felt or rubber for example, is placed adjacent to the frame 30 so that a horizontal portion of the membrane 70 is disposed over a portion of the roof 12 and a vertical portion of the membrane 70 is placed adjacent to all four exterior vertical sides of the frame 30. The sill flashing 75 and the head flashing 80 are then placed in abutting relationship with the frame 30 and the membrane 70. The sill flashing 75 and head flashing 80 are partially situated over the top of the membrane 70. The metal step flashing 65 along with the roofing shingles (not shown) can then be installed on the roof 12. Flashing 65, 75 and 80 is preferably sheet metal but other materials are permissible. The step flashing 65 is interwoven with the shingles as is well known in the art. The shingles are exposed to environmental elements, such as rain, sleet, or snow. The roofing materials are well known in the art and are manufactured of various materials depending upon aesthetics, functionality, and the economics of a particular installation.

The sash 10 can then be placed over the frame 30 which already is prepared with the roof membrane 70 and flashing 65 as set forth above. The sash 10 "snaps" onto the frame 30 and the proper weatherproof installation is complete. The roof membrane 70 is disposed over the exposed portion of the roof 12 and between the frame 30 and the counterflashing 14 of the sash 22. Flashing 65 is over the roofing membrane 70 and between the counterflashing 14 of the sash 22 and the frame member 30. The situation of the roof membrane 70 and flashing 65 between the counterflashing 14 of the sash 22 and the frame 30 is obtained by the placement of the sash 22 onto the frame 30 after the roof membrane 70 and flashing 65 have been placed adjacent to the frame 30.

Another aspect of the invention is a method of installing a roof window assembly to cover an opening in a structure of a building and a method of removing the window from the frame. The roof window assembly includes a glass unit 20, a sash member 22, a frame member 30, and a detent arrangement 40. The glass unit 20 is operatively connected to the sash member 22. The frame member is adapted and configured to be secured to the structure proximate its opening. The detent arrangement 40 is on the frame member 30 and sash member 22.

The steps for installing the roof window assembly are; securing the frame member 30 around the opening in the structure, weatherproofing the frame member 30 to the building structure with a flashing system, placing the sash member 22 over the frame member 30 while the detent arrangement 40 is in a disengaged position and positioning the sash into an assembled position as the detent arrangement 40 is moved into an engaged position.

The steps for installing the roof window assembly and later removing the sash from the frame are; securing the frame member 30 around the opening in the structure, placing the sash member 22 over the frame member 30 while the detent arrangement 40 is in a disengaged position, positioning the sash in an assembled position as the detent arrangement 40 is in an engaged position, placing a tool 60 in the hole 45 to move the detent arrangement 40 from the engaged position to the disengaged position and removing the sash member 22 from the frame member 30.

These and other advantages and features, which characterize the invention, are set forth in the claims annexed hereto and form a further part thereof However, for a better understanding of the invention, and the advantages and objectives obtained by its use, reference should be made to the drawings, and to the accompanying descriptive matter, in which there is described a preferred embodiment of the invention.

We claim:

1. A roof window assembly adapted to be mounted to cover an opening in a roof structure of a building, comprising:

a) a glass unit;

b) a sash member, the glass unit operatively connected to the sash member, wherein the sash member comprises a counterflashing member;

c) a frame member comprising an inner vertical side and an outer vertical side, wherein the frame member is adapted and configured to be secured to the roof structure proximate its opening wherein the inner vertical side of the frame member is the vertical side configured to be positioned nearest to the center of the opening and wherein the outer vertical side of the frame member is positioned on the opposite side of the frame member from the inner vertical side; and d) a detent arrangement on the inner vertical side of the frame member and the sash member, wherein the detent arrangement removably secures the sash member to the frame member, and wherein the sash is configured such that the counterflashing member is substantially parallel to the out vertical side of the frame member to create a receiving slot between the counterflashing member and the outer vertical side when the sash member is removably secured to the frame member by the detent arrangement.

2. The window of claim 1, wherein the detent arrangement comprises a first part connected to the frame member and a second part connected to the sash member.

3. The window of claim 2, wherein the first part of the detent arrangement has a first engaged position and a second disengaged position and said second part is a catch.

4. The window of claim 3 further comprising the sash member having a profile and the profile having an opening located adjacent the first part of the detent arrangement, whereby access is available to move the first part from the engaged to the disengaged position, thereby allowing easy removal of the sash member from the frame member.

5. The window of claim 3, wherein the first part comprises a spring clip mounted to the frame member and the sash member having a profile shaped and configured to be placed over the frame member, the catch comprising a ridge member in the profile, wherein as the sash member is placed over the frame, the ridge member depresses the spring clip to the disengaged position until the ridge member passes the clip which then allows the spring clip to move to the engaged position.

6. A roof window assembly adapted to be mounted to cover an opening in a roof structure of a building, comprising:

a) a glass unit;

b) a sash member, the glass unit operatively connected to the sash member, wherein the sash member comprises a counterflashing member;

c) a frame member comprising an inner vertical side and an outer vertical side, wherein the frame member is adapted and configured to be secured to the structure proximate its opening wherein the inner vertical side of the frame member is the vertical side configured to be positioned nearest the center of the opening and wherein the outer vertical side of the frame member is positioned on the opposite side of the frame member from the inner vertical side;

d) a spring clip operatively connected to the inner vertical side of the frame member, the clip having an extended, engaged position and a depressed, disengaged position; and e) the sash member having a profile adapted and configured to be placed on the frame member, the sash member having a ridge member, the ridge member positioned to depress the spring clip as the sash member is placed on the frame member and to allow the release of the spring clip to its extended position when the sash member and frame members are in a final assembled position, the sash member and spring clip forming a snap fit arrangement for the roof window assembly, wherein the counterflashing member is configured to be positioned substantially parallel to the out vertical side of the frame member to create a receiving slot between the counterflashing member and the outer vertical side when the sash member and the frame members are in the final assembled position.

7. The roof window assembly of claim 6, further comprising the profile defining an opening located adjacent the spring clip, whereby access is available to move the spring clip from the engaged to the disengaged position, thereby allowing easy removal of the sash member from the frame member.

8. A method of installing a roof window assembly to cover an opening in a structure of a building, the roof window assembly comprising: a glass unit; a sash member, said glass unit operatively connected to sash member, wherein the sash member comprises a counterflashing member; a frame member comprising an inner vertical side and an outer vertical side wherein the frame member is adapted and configured to be secured to the structure proximate its opening, wherein the inner vertical side of the frame member is the vertical side configured to be positioned nearest the center of the opening and wherein the outer vertical side of the frame member is positioned on the opposite side of the frame member from the inner vertical side; and a detent arrangement on the frame member and the sash member, the method comprising:

a) securing the frame member around the opening in the structure;

b) placing a roofing membrane in adjacent contact with the outer vertical side of the frame member;

c) placing the sash member over the frame while the detent arrangement is in a disengaged position; and d) positioning the sash member in an assembled position such that the detent arrangement is in an engaged position and wherein the counterflashing is positioned adjacent the roofing membrane such that the roofing membrane is positioned between the outer vertical side of the frame membrane member and the counterflashing of the sash member.

9. The method of claim 8 further comprising placing a flashing member in adjacent contact with the roofing membrane prior to placing the sash member over the frame member such that placement of the sash member over the frame member and positioning of the sash member in an assembled position results in the flashing member being situated between the counterflashing of the sash member and the outer vertical side of the frame member.

10. A roof window assembly adapted to be mounted to cover an opening in a roof structure of a building, comprising:

a) a glass unit;

b) a sash member, the glass unit operatively connected to the sash member;

c) a frame member adapted and configured to be secured to the structure proximate its openings;

d) a spring clip operatively connected to the frame member, the clip having an extended, engaged position and a depressed, disengaged position;

e) the sash member having a profile adapted and configured to be placed on the frame member, the sash member having a ridge member, the ridge member positioned to depress the spring clip as the sash member is placed on the frame member and to allow the release of the spring clip to its extended position when the sash member and frame members are in a final assembled position, the sash member and spring clip forming a snap fit arrangement for the roof window assembly, wherein the sash member profile defines an access opening located adjacent the spring clip, whereby access is available to move the spring clip from the engaged position to the disengaged position, thereby allowing easy removal of the sash member from the frame member.

11. A method of installing and later removing a roof window assembly to cover an opening in a structure in a structure of a building, the roof window assembly comprising a glass unit, a sash member, said glass unit operatively connected to the sash, a frame member adapted and configured to be secured to the structure proximate its opening, and a detent arrangement on the frame member and the sash member, the sash member having a profile and the profile having an opening adjacent the detent assembly on the frame member, comprising:

a) securing the frame member around the opening in the structure;

b) placing the sash member over the frame member while the detent arrangement is in a disengaged position;

c) positioning the sash member in an assembled position as the detent arrangement is in an engaged position;

d) placing a tool into opening in the sash member profile to move the detent arrangement from the engaged position to the unengaged position; and e) removing the sash member from the frame.

12. The method of claim 11, wherein the frame member has a vertical exterior surface located on the outside of the frame member and wherein the sash member includes a vertical counterflashing, the method further comprising placing a roofing membrane in adjacent contact with the vertical exterior surface of the frame member prior to placing the sash member over the frame member such that placement of the sash member over the frame member and positioning of the sash member in an assembled position results in the roofing membrane being situated between the counterflashing of the sash member and the frame member.

13. The method of claim 12 further comprising placing a flashing member in adjacent contact with the roofing membrane prior to placing the sash member over the frame member such that placement of the sash member over the frame member and positioning of the sash member in an assembled position results in the flashing member being situated between the counterflashing of the sash member and the frame member.

14. A roof window assembly adapted to be mounted to cover an opening in a roof structure of a building, comprising:

a) a glass unit;

b) a sash member operatively connected to the glass unit, the sash member having a profile and the profile defining an access opening;

c) a frame member adapted and configured to be secured to the roof structure proximate its opening; and d) a detent arrangement comprising a first part connected to the frame member and a second part connected to sash member, wherein the first part of the detent arrangement has a first engaged position and a second disengaged position and said second part is a catch, wherein after the frame member is secured to the roof, the sash member is placed on the frame member and the detent arrangement mechanically secures the sash member to the frame member, wherein the opening defined in the profile of the sash member is located adjacent the first part of the detent arrangement, whereby access is available to move the first part from the engaged position to the disengaged position, thereby allowing easy removal of the sash member from the frame member.

15. A method of installing a roof window assembly to cover an opening in a structure of a building, the roof window assembly comprising a glass unit, a sash member comprising a vertical counterflashing, said glass unit operatively connected to the sash member, a frame member adapted and configured to be secured to the structure proximate its opening, wherein the frame member has a vertical exterior surface located on the outside of the frame member, and a detent arrangement on the frame member and the sash member, comprising:

a) securing the frame member around the opening in the structure;

b) placing a roofing membrane in adjacent contact with the vertical exterior surface of the frame member;

c) placing the sash member over the frame while the detent arrangement is in a disengaged position; and d) positioning the sash member in an assembled position such that the detent arrangement is in an engaged position wherein the roofing membrane is positioned between the counterflashing of the sash member and the frame member.

* * * * *